United States Patent [19]

Takemae et al.

[11] Patent Number: 4,837,903

[45] Date of Patent: Jun. 13, 1989

[54] METHOD AND APPARATUS FOR PRODUCING SLUB YARN

[75] Inventors: Shigeru Takemae; Mitsuhiro Kodama, both of Nagoya, Japan

[73] Assignee: Mitsubishi Rayon Company Ltd., Tokyo, Japan

[21] Appl. No.: 696,461

[22] Filed: Jan. 30, 1985

[51] Int. Cl.[4] ..... D02G 1/16; D02J 1/06; D02J 1/08

[52] U.S. Cl. ..... 28/254; 28/252; 28/258

[58] Field of Search ..... 28/247, 252, 254, 258; 264/180

[56] References Cited

U.S. PATENT DOCUMENTS

| | | | |
|---|---|---|---|
| 2,282,568 | 5/1942 | Finzel | 28/281 X |
| 2,439,034 | 4/1948 | Battista | 28/247 X |
| 2,730,757 | 1/1956 | Hofmann | 264/180 X |
| 2,878,547 | 3/1959 | McMaster et al. | 28/289 X |
| 3,116,589 | 1/1964 | Edwards et al. | 28/254 X |
| 3,174,271 | 3/1965 | Edwards et al. | 28/254 X |
| 3,296,785 | 1/1967 | Hardy III | 28/254 X |
| 3,474,613 | 10/1969 | Joarder et al. | 28/254 X |

*Primary Examiner*—Robert R. Mackey

*Attorney, Agent, or Firm*—Finnegan, Henderson, Farabow, Garrett & Dunner

[57] ABSTRACT

A method and an apparatus for producing a slub yarn from a filament yarn, in which the starting yarn is propelled by an air stream at a first rate and made to impinge on a liquid (water) surface, whereby the yarn is opened to individual single filaments which entangle and fold with each other to form a thicker portion in the yarn body, while being held in a slack condition in the water and finally withdrawn therefrom at a second rate lower than the first rate. The water is preferably whirled to form a vortex. Interlacing of the yarn after withdrawal from the water is also preferable to strengthen the yarn structure.

5 Claims, 4 Drawing Sheets

METHOD AND APPARATUS FOR PRODUCING SLUB YARN

BACKGROUND OF THE INVENTION

1. Field of the Invention

The present invention relates to treatment of a filament yarn to produce a slub yarn, especially having a silk douppion-like configuration.

2. Description of the Related Art

Slub yarns, well known in the art, have a plurality of thicker portions along the yarn length. Such yarns are of interest because of the aesthetic properties they impart to fabric prepared therefrom.

Many proposals have been made for obtaining such slub yarns from a synthetic filament yarn. Edwards et al. U.S. Pat. No. 3,116,589, issued Jan. 7, 1964; Myers U.S. Pat. No. 3,433,007, issued Mar. 18, 1969; Joarder et al. U.S. Pat. No. 3,474,613, issued Oct. 28, 1969; and Adachi et al. U.S. Pat. No. 3,914,929, issued Oct. 28, 1975 are examples of such art.

According to these prior arts, however, the yarn is mainly treated by an air stream. This means a voluminous air consumption, resulting in high production costs. Moreover, since the process conditions are critical, it is difficult to produce various configuration yarns in accordance with changing market needs.

SUMMARY OF THE INVENTION

Accordingly, it is an object of the present invention to provide a novel method for producing a slub yarn from a filament yarn by mainly utilizing a liquid (water) as a texturing medium, though air is utilized as a subsidiary medium.

It is another object of the present invention to provide an apparatus for carrying out the above method.

According to a first aspect of the present invention, a method is provided in which a multifilament yarn composed of a plurality of single filaments is caused to successively impinge onto a surface of a liquid medium at a first rate. Then, the yarn is held freely in the liquid medium, in which the single filaments are individually opened and folded and/or entangled with each other to form a thicker portion in the yarn. Thereafter, the yarn is successively withdrawn from the liquid medium at a second rate lower than the first rate as a slub yarn.

The liquid medium is preferably tap water or well water of a normal temperature but may contain a conventional fiber treatment agent, such as a sizing agent, oil, or dye.

Further, the liquid medium is preferably in a vortical state for enhancing the texturing action.

Interlacing of the yarn after withdrawal from the liquid medium is very useful for fixation of the yarn structure to enable stable processing of the resultant yarn during post-treatment such as winding or weaving.

In order to have the yarn stay in the liquid medium a sufficient time, the yarn is preferably subjected to a gas stream which tends to drag the yarn back to the liquid medium. Also, much of the liquid medium adhered to the yarn can be removed by the gas stream.

Further, for improving the mechanical properties of the resultant yarn, a carrier yarn may be doubled with the yarn withdrawn from the liquid medium and interlaced therewith.

A second aspect of the present invention is an apparatus for carrying out the above methods. The apparatus includes a feed roller for introducing yarn to be treated into a texturing zone and a delivery roller for withdrawing the yarn therefrom. In the texturing zone, a first gas nozzle for creating a first gas stream and a bath for accommodating a liquid medium therein are provided. The first gas stream accelerates the yarn toward a surface of the liquid medium, whereby the yarn fed into the texturing zone by the feed roller is caused to impinge onto the surface of the liquid medium along with the first gas stream and, thereafter, is withdrawn therefrom by the delivery roller.

The apparatus may be provided with a rotating vane for creating a vortex in the liquid medium.

Further, it is preferable to provide a second gas nozzle downstream of the bath for decelerating withdrawal of the yarn.

Provision of interlacing means at a final stage in the texturing zone is also preferable.

BRIEF DESCRIPTION OF THE DRAWINGS

Other objects and features of the present invention will be apparent from the following description with reference to the drawings illustrating preferable embodiments of the present invention, wherein.

The same reference numerals are utilized for designating identical or similar parts through all the drawings.

DESCRIPTION OF THE PREFERRED EMBODIMENTS

According to the present invention, a douppion-like fancy yarn is obtained from a filament yarn. Here, "douppion" means a silk filament yarn reeled from a double cocoon, having a plurality of multifolded portions of various size along the yarn length, favorably used for making a shantung cloth.

Figure 1:
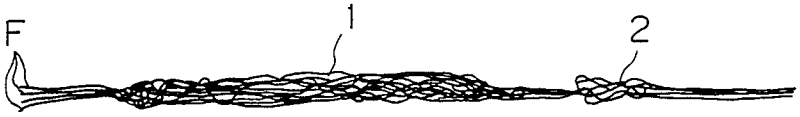
FIG. 1 is typical configuration of the resultant yarn obtained by the present invention.

A typical configuration of the yarn obtained by the present invention is illustrated in FIG. 1, wherein single filaments F composing the yarn are folded and/or entangled with each other and form a plurality of slubs 1 (longer portion) and neps 2 (shorter portions) over an entire length thereof.

The yarn used as a starting material must be a multifilament yarn. Such a yarn may be of rayon, acetate, polyamide, polyacrylic, or polyester. Polyester is the most preferable.

Figure 2:
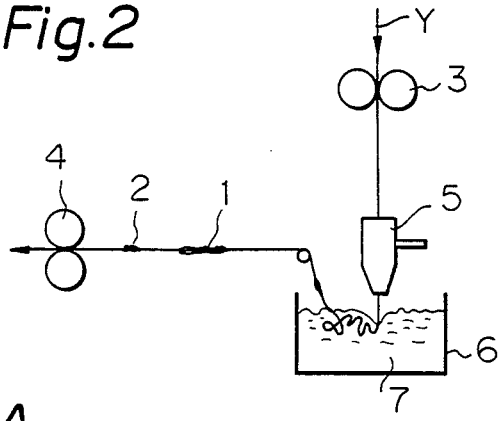
FIGS. 2 and 4 to 8 are schematic side views of various embodiments of apparatus according to the present invention.
Figure 3A:
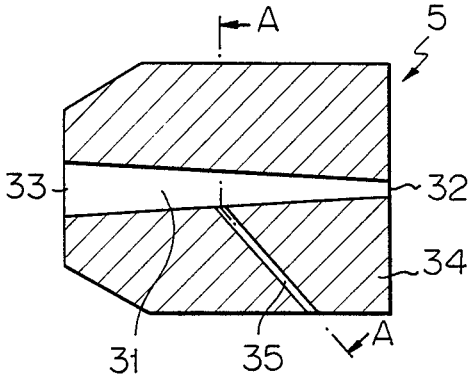
FIGS. 3A and 3B are front and side sectional views, respectively, of a typical gas nozzle utilized for the present invention.
Figure 3B:
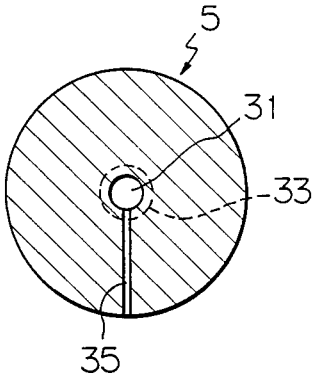

The principle of the present invention is described based on FIG. 2 illustrating a first embodiment of the present invention. Basically, the apparatus includes a feed roller 3 and a delivery roller 4 for forwarding a yarn Y to be processed, between which a texturing zone is provided. Periphery speeds of the feed roller 3 and the delivery roller 4 are adjustable according to the processing conditions. However, the speed of the former must be higher than that of the latter so that an overfeed state of the yarn is established. In the texturing zone, a first gas nozzle 5 is provided downstream of the feed roller 3. The nozzle 5 has a structure illustrated in FIGS. 3A and 3B. That is, a central channel 31 having a cross-section diverged from an inlet 32 to an exit 33 is bored through a body 34 as a yarn passage and a gas jet 35 connected to a high-pressure gas source (not shown) is opened midway in the channel 31 through a wall of the body 34. The gas jet 35 is inclined with respect to the exit 33 so that the yarn Y passing through the channel 31 can be forwardly accelerated.

Directly below the exit 33 of the nozzle 5, a bath 6 is disposed. The bath 6 is opened at the top portion and a liquid medium 7 is filled therein (since water is the best liquid medium for the present invention, hereinafter we use "water" as representative of "liquid medium"). Thus, the nozzle 5 directly faces the water surface.

The yarn Y of the multifilament is supplied in the texturing zone by means of the feed roller 3 at a constant rate and is introduced into the nozzle 5 through the inlet 32, where a gas is ejected from the gas jet 35, whereby the yarn is propelled toward the exit 33 (since air is the best gas for the present invention, hereinafter we use "air" as representative of "gas").

The yarn Y exhausted from the exit 33 impinges on the surface of water 7 along with air. Running of the yarn Y is forced to stop by this impingement, and the yarn Y is immersed in the water 7 in a zigzag form to compensate for a slack condition caused by the overfeed state. Since the yarn portion immersed in the water is maintained in a tensionless state, individual filaments composing the yarn Y tend to open from each other due to the separating action of the water. Further, the water surface is disturbed and stirred by the air exhausted from the nozzle 5 and the kinetic energy of the yarn Y itself. Under such circumstances, the individual filaments of the yarn Y are entangled and folded with each other, while randomly moving in the water, to form a plurality of slubs 1 and neps 2 in the yarn body, as illustrated in FIG. 1. Thereafter, the yarn Y is withdrawn from the water 7, keeping the thicker portions 1 and 2 in the yarn body, by means of the delivery roller 4 and is taken up on a bobbin (not shown) in a conventional manner.

Figure 4:
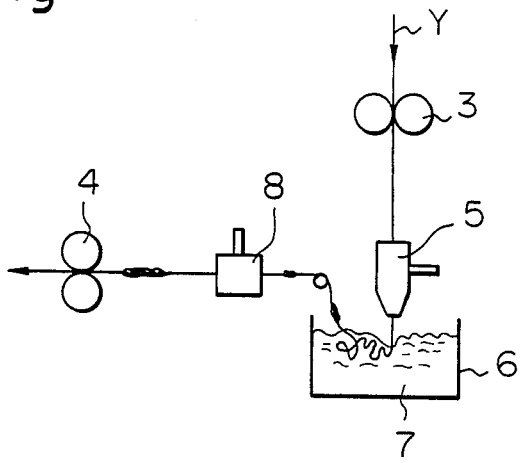

FIG. 4 illustrates a second embodiment of the present invention, in which an interlacing nozzle 8 for interlacing the yarn Y is disposed prior to the delivery roller 4. The nozzle 8 has a conventional structure such as disclosed in U.S. Pat. No. 3,863,309 of S. T. Price, issued on Feb. 4, 1975 and functions to interlace the individual filaments of the yarn Y to each other. Thus, the yarn Y is interlaced after being withdrawn from the water 7, whereby the slubbed structure is strengthened. In this regard, since the apparent weight of the yarn Y has been increased by the water adhered thereto, the interlacing effect of the nozzle 8 is improved compared to that obtained under the normal dry state and the tighter fixation of the slub structure is achievable even with less volume of air. Moreover, the water adhered to the yarn Y can be removed by this interlacing, whereby the dehydrating process can be eliminated.

Figure 5:
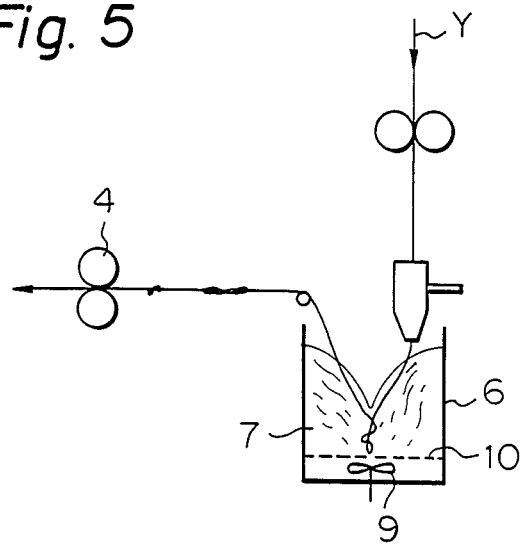
Figure 6:
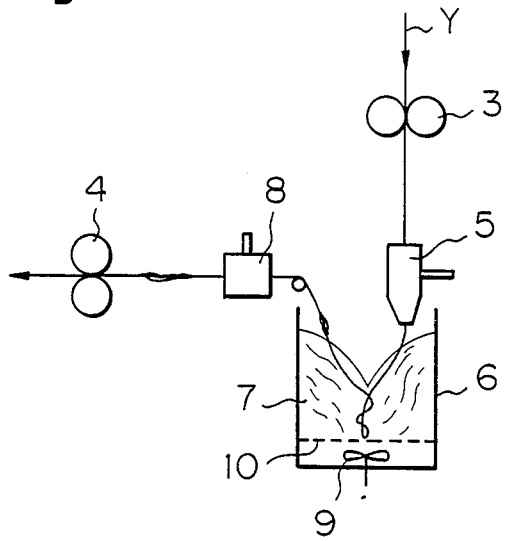

According to third and fourth embodiments illustrated in FIGS. 5 and 6, respectively, the bath 6 is provided with a rotating vane 9 at the bottom thereof, by which the water 7 is positively whirled to form a vortex in the bath 6. Due to the vortex, the yarn Y immersed in the water 7 is moved more vigorously than in the case of the preceding embodiments and entanglement and folding of the single filaments is facilitated. A net 10 may be provided for preventing the yarn from entwinement around the vane 9.

Figure 7:
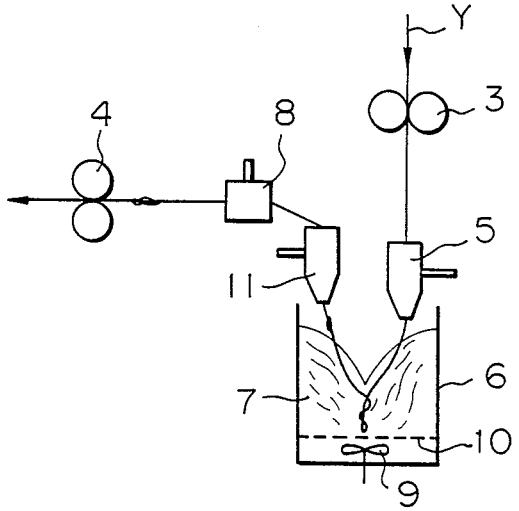

FIG. 7 illustrates a fifth embodiment of the present invention, in which a second gas nozzle 11 is additionally provided between the bath 6 and the interlacing nozzle 8, compared to the fourth embodiment. The second gas nozzle 11 has substantially the same structure as the first gas nozzle 3 illustrated in FIGS. 3A and 3B, but is disposed, relative to the yarn passage, in the reverse direction to that of the first gas nozzle 5 so that the yarn Y is subjected to a counter directional air stream. If there is no second nozzle 11, the yarn Y may be rather rapidly withdrawn from the water 7 in a lower tensioned state, which substantially decreases the length of the yarn Y held in the water 7. Contrary to this, the provision of the second nozzle 11 enables the yarn Y to be tensioned in the passage between the bath 6 and the nozzle 11, which results in a longer held length and dwelling time of the yarn Y in the water 7, whereby sufficient texturing treatment of the yarn can be achieved even under the lower overfeed ratio.

In the above fifth embodiment, it is possible to eliminate the interlacing nozzle 8 if the second gas nozzle 11 has an interlacing function beside the yarn tensioning function.

Figure 8:
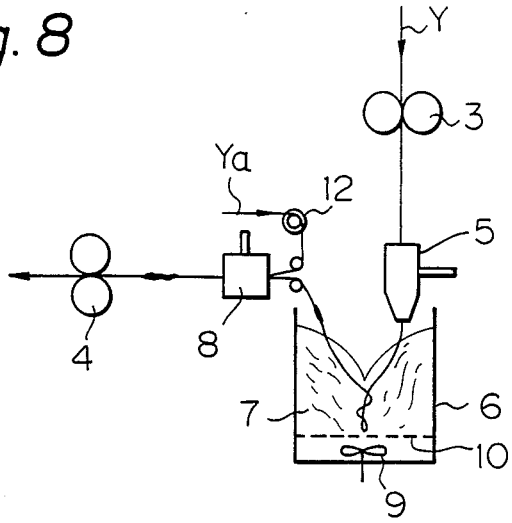

A further improvement of the present invention is illustrated in FIG. 8 as a sixth embodiment. In this case, a carrier yarn Ya of multifilament is doubled through a magnet tensor 12 to the yarn Y withdrawn from the water 7 before introduction to the interlacing nozzle 8. The two yarns Y and Ya are entangled to each other while passing through the interlacing nozzle 8. According to the addition of the carrier yarn Ya, the mechanical properties of the resultant yarn can be improved to a great extent and stable operations are achievable in this yarn texturing process as well as in the post treatment of the yarn, such as rewinding or weaving.

The present invention is applicable not only on a raw filament yarn as stated above, but also on a textured yarn produced, for example, by a false-twist texturing machine and a draw-texturing machine. In this connection, such a conventional texturing machine can be combined upstream of the apparatus according to the present invention in a continuous manner.

Effects of the present invention will be apparent from the following example:

EXAMPLE 1

Various samples of the fancy yarn were obtained from a starting yarn of polyester filament 2×50 d/36 f in a doubled state by Run Nos. 1 to 6, each being carried out by means of the apparatus illustrated in FIGS. 2 and 4 to 8, respectively. The yarn configurations of the samples were inspected, results of which are listed on Table 1.

The sample yarns were woven, as a weft, to a plain weave fabric having a warp composed of polyester filament yarn 75 d/48 f, so that yarn densities of 94 warp/in. and 65 weft/in. are obtained. The respective fabric had an elegant appearance like a silk shantung cloth.

TABLE 1

| Run | Apparatus | Processing speed (m/min) | Overfeed*2 ratio (+ %) | Air pressure 1st nozzle (kg/cm²) | Air pressure 2nd nozzle (kg/cm²) | Interlacing nozzle (kg/cm²) | Rotation of rotating vane (rpm) | Thicker portion Length (nm) | Thicker portion Thickness ratio to normal portion |
|---|---|---|---|---|---|---|---|---|---|
| 1 | FIG. 2 | 120 | 12 | 1.5 | — | — | — | 2 to 400 | 1.2 ro 6.0 |
| 2 | FIG. 4 | 120 | 12 | 1.5 | — | 1.5 | — | 2 to 500 | 1.2 to 6.0 |
| 3 | FIG. 5 | 120 | 10 | 1.5 | — | — | 1700 | 2 to 600 | 1.2 to 6.0 |
| 4 | FIG. 6 | 450 | 10 | 2.0 | — | 4.0 | 1700 | 2 to 800 | 1.2 to 6.0 |
| 5 | FIG. 7 | 120 | 6 | 1.5 | 2.0 | 1.5 | 1700 | 2 to 500 | 1.2 to 6.0 |
| 6*1 | FIG. 8 | 450 | 10 | 2.0 | — | 4.0 | 1700 | 2 to 800 | 1.2 to 6.0 |

Note:
*1: In Run No. 6, a starting yarn was a single yarn of 50 d/36 f and the identical yarn was doubled as a carrier yarn.
*2: Over feed ratio O.F. is defined by the formula $$O.F. = \frac{V_F - V_D}{V_D} \times 100\ (\%)$$

where $V_F$ stands for a peripheral speed of a feed roller and $V_D$ stands for that of a delivery roller.

EXAMPLE 2

Figure 9:
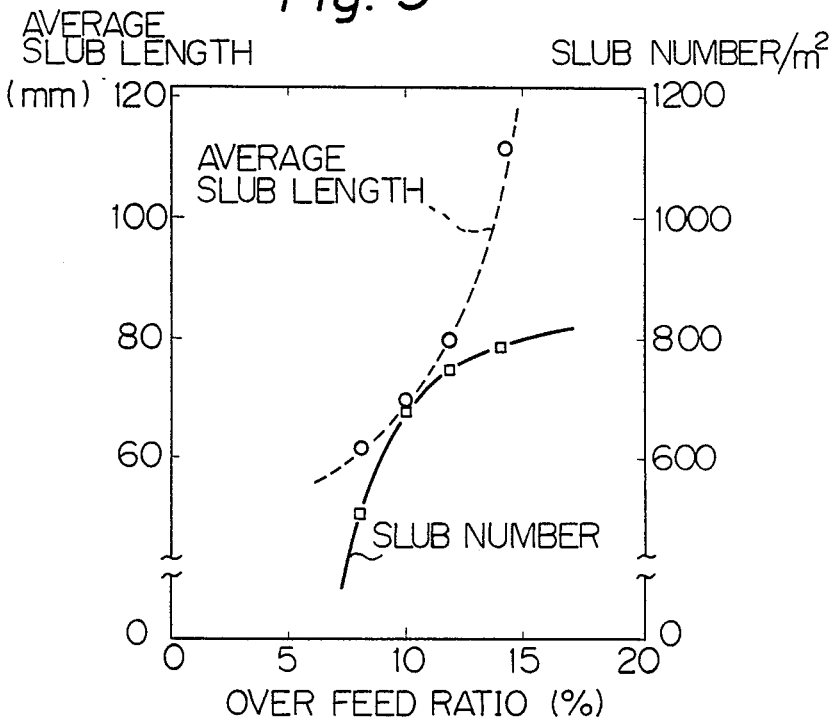
FIG. 9 is a graph illustrating a relationship between an overfeed ratio of a yarn and parameters of a thicker portion of the resultant yarn obtained by the present invention.

In order to clarify the effect of the overfeed ratio of the yarn on the yarn configuration, tests were carried out under similar conditions as Run 3 of Example 1, except for the overfeed ratio, which was varied to several levels. The results are summarized in the graph of FIG. 9, in which the number and the length of the thicker portion of the yarn are selected as parameters of the yarn configuration.

These parameters were measured as follows:

1. Sample yarns were woven, as a weft, to a plain weave fabric as in the case of Example 1.
2. The thicker portions of the yarn were inspected in an area of 20 cm×20 cm on the fabric and the average length and the number thereof per 1 m² area were obtained.

As shown in graph, both parameters increase as the overfeed ratio increases.

EXAMPLE 3

A conventional false-twist texturing machine of a double-heater type was continuously combined to the apparatus shown in FIG. 6 in such a manner that the delivery roller for the yarn output from the second heater is utilized as the feed roller 3 of the apparatus proper to the present invention.

A fancy yarn was produced from a starting yarn of polyester filament 75 d/36 f by means of this combined apparatus under the following processing conditions:

| | |
|---|---|
| Processing speed: | 120 m/min |
| Overfeed ratio (relative to the subsequent roller) | |
| in the false-twisting zone: | +2.5% |
| in the relax zone: | +10% |
| in the texturing zone of the present invention: | +7% |
| Number of false-twists: | 2600 T/M in Z direction |
| Air pressure | |
| 1st gas nozzle: | 1.5 kg/cm² |
| Interlacing nozzle: | 1.5 kg/cm² |
| Rotation of vane: | 1700 rpm |

The resultant yarn had a plurality of thicker portions having a length in a range of 2 mm to 400 mm and a thickness ratio in a range of 2 to 7 relative to a normal portion of the yarn. A similar fabric as that obtained from Example 1 but richer in bulkiness resulted from this yarn.

As stated above, according to the present invention, a slub yarn having an appearance like a silk douppion is obtained by a synthetic filament yarn at a high production rate. Since the yarn length held in the liquid medium can be optionally controlled by an overfeed ratio between the feed and delivery rollers, yarns having various slub sizes are stably obtainable. By the adoption of liquid as a main texturing medium instead of air, a considerable amount of pressurized air consumption can be eliminated compared to the prior art.

We claim:

1. A method for producing a slub yarn like a silk douppion from a yarn, comprising steps of:

a. causing a multifilament yarn composed of a plurality of single filaments successively to impinge onto a surface of a liquid medium at a first rate by a first gas stream directed to accelerate feed of said yarn,
b. holding a length of said yarn freely in said liquid medium, in which said single filaments are individually opened and folded and/or entangled with each other to form a thicker portion in said yarn,
c. whirling said liquid medium to form a vortex therein to facilitate folding and entanglement of said filaments,
d. withdrawing said yarn from the liquid medium successively at a second rate lower than said first rate,
e. doubling a carrier yarn of synthetic multifilament to said yarn after withdrawing from the liquid medium, and
f. interlacing said yarn after said doubling.

2. A method according to claim 1, wherein said step d is carried out while said yarn is subjected to a second gas stream directed to decelerate the withdrawal of said yarn.

3. An apparatus for producing a slub yarn like a silk douppion from a yarn, comprising a feed roller for introducing a yarn to be treated into a texturing zone and a delivery roller for withdrawing said yarn therefrom, wherein a first gas nozzle for creating a first gas stream and a bath for accommodating a liquid medium therein are provided in said texturing zone, said bath being provided with a rotating vane for creating a vortex in said liquid medium, said first gas stream accelerating said yarn to a surface of said liquid medium, whereby said yarn fed into said texturing zone by said feed roller impinges onto the surface of said liquid medium along with said first gas stream and, thereafter, is withdrawn therefrom by said delivery roller.

4. An apparatus according to claim 3, further comprising a second gas nozzle disposed downstream of said bath, for decelerating withdrawal of said yarn.

5. An apparatus according to any one of claims 3 or 4, further comprising interlacing means disposed upstream of said delivery roller.

* * * * *